US010582302B2

(12) United States Patent
Teng

(10) Patent No.: US 10,582,302 B2
(45) Date of Patent: Mar. 3, 2020

(54) PLANAR DIAPHRAGM DRIVER HAVING AN IMPROVED STRUCTURE

(71) Applicant: Ko-Chung Teng, Taipei (TW)

(72) Inventor: Ko-Chung Teng, Taipei (TW)

( * ) Notice: Subject to any disclaimer, the term of this patent is extended or adjusted under 35 U.S.C. 154(b) by 0 days.

(21) Appl. No.: 16/304,963

(22) PCT Filed: May 31, 2016

(86) PCT No.: PCT/CN2016/084127
§ 371 (c)(1),
(2) Date: Nov. 27, 2018

(87) PCT Pub. No.: WO2017/206065
PCT Pub. Date: Dec. 7, 2017

(65) Prior Publication Data

US 2020/0015015 A1 Jan. 9, 2020

(51) Int. Cl.
*H04R 11/02* (2006.01)
*H04R 7/06* (2006.01)
*H04R 9/04* (2006.01)

(52) U.S. Cl.
CPC ..... *H04R 7/06* (2013.01); *H04R 9/047* (2013.01)

(58) Field of Classification Search
CPC combination set(s) only.
See application file for complete search history.

(56) References Cited

U.S. PATENT DOCUMENTS 8,520,887 B2 * 8/2013 Simidian, II ..... H04R 31/006 381/408
2014/0105445 A1 * 4/2014 Kim ..... H04R 9/047 381/431
2016/0014518 A1 1/2016 Liu et al.

FOREIGN PATENT DOCUMENTS

CN 201234340 Y 5/2009
CN 201267010 Y 7/2009
CN 203933933 U 11/2014
CN 105282663 A 1/2016
JP 2007020024 A 1/2007

* cited by examiner

*Primary Examiner* — Amir H Etesam
(74) *Attorney, Agent, or Firm* — Muncy, Geissler, Olds & Lowe, P.C.

(57) ABSTRACT

An improved planar diaphragm driver includes: a membrane; a first coil, disposed at a first side on a first surface of the membrane; a second coil, disposed at a first side on a second surface of the membrane and electrically connected to the first coil; a third coil, disposed at a second side on the first surface of the membrane and electrically connected to the second coil; and a fourth coil, disposed at a second side on the second surface of the membrane and electrically connected to the third coil. The first and third coils are configured to have a same flowing direction of an electric current at both respective locations thereon equidistant from a central axis of the membrane, and the second and fourth coils also are configured to have a same flowing direction of the electric current at both respective locations thereon equidistant from the central axis.

6 Claims, 4 Drawing Sheets

PLANAR DIAPHRAGM DRIVER HAVING AN IMPROVED STRUCTURE

BACKGROUND OF THE INVENTION

1. Field of the Invention

The present invention relates to a diaphragm structure, and more particularly to a planar diaphragm driver having an improved structure that can reduce the occurrence of break damages.

2. The Prior Arts

Depending on the structure and mechanism implemented for emitting sounds, different types of loudspeakers can include coil loudspeakers, piezoelectric loudspeakers, ceramic piezoelectric loudspeakers, paper loudspeakers, and the like. Among the existing types, moving coil loudspeakers are the most widely used one. A moving coil loudspeaker mainly includes a magnet wire that is wound around a cylindrical post to form a voice coil, which has one end adhered to a side of a diaphragm. This assembly is placed at a side of a magnet to form a driver of the moving coil loudspeaker. In operation, an electric current corresponding to a sound frequency is fed along the coil so as to cause a modification in a magnetic field of the coil owing to electromagnetic induction and thereby drive vibration of the diaphragm to agitate the air and produce sounds.

FIG. 1A shows a conventional driver structure. As shown in FIG. 1A, the conventional driver structure 9 has a diaphragm 91 on which only one single coil 92 is provided. When an electric current corresponding to a sound frequency is fed along the coil 92 of the conventional driver structure 9, the electric current would flow in different directions at equidistant locations on two sides of the coil 29 with respect to a central axis 95 of the coil 92, which may easily cause break problems. For example, with reference to FIG. 1A, suppose that an electric current at point a on the right side of the coil 92 flows downward, the electric current at point a' located on the other side of the coil 92 at the same distance from the central axis 95 as the point a will flow upward. FIG. 1B is a side view of the diaphragm 91. The arrows in FIG. 1B show vibrating directions of the diaphragm 91 at a microscopic level. As shown in FIG. 1B, because the aforementioned coil arrangement results in an electric current that has opposite flowing directions at points a and a', the diaphragm 91 would be subjected to different vibrating directions at points a and a'. As a result, the conventional driver structure 9 could break or tear more easily, which can cause sound distortion.

SUMMARY OF THE INVENTION

An objective of the present invention is to provide a planar diaphragm driver having an improved structure, which has a coil arrangement that is subjected to a same flowing direction of an electric current at two equidistant locations with respect to a central axis, thereby reducing the occurrence of break and/or tear in the diaphragm.

For achieving the foregoing objective, the present invention provides a planar diaphragm driver having an improved structure that comprises: a membrane, a first coil, a second coil, a third coil and a fourth coil. The membrane has a first surface and a second surface, and a first and a second side opposite to each other relative to a central axis of the membrane. The first coil is disposed at the first side on the first surface of the membrane, and has a first contact point. The second coil is disposed at the first side on the second surface of the membrane, and is electrically connected to the first coil via a first connection point. The third coil is disposed at the second side on the first surface of the membrane, and is electrically connected to the second coil via a second connection point. The fourth coil is disposed at the second side on the second surface of the membrane, and is electrically connected to the third coil via a third connection point, the fourth coil having a second contact point. The first coil and the third coil are configured so that a flowing direction of an electric current is the same at two respective locations on the first coil and the third coil equidistant from the central axis, and the second coil and the fourth coil are configured so that a flowing direction of an electric current is the same at two respective locations on the second coil and the fourth coil equidistant from the central axis.

According to an embodiment of the present invention, the first coil and the third coil are symmetric to each other relative to the central axis, and the second coil and the fourth coil are symmetric to each other relative to the central axis.

According to an embodiment of the present invention, the second coil overlaps with the first coil, the fourth coil overlaps with the third coil, a flowing direction of an electric current in a region where the second coil overlaps with the first coil being the same, and a flowing direction of an electric current in a region where the fourth coil overlaps with the third coil being the same. Moreover, the second coil and the fourth coil are disposed on the second surface of the membrane with a smallest number of turns.

DETAILED DESCRIPTION OF THE PREFERRED EMBODIMENT

Reference is made hereinafter to the accompanying drawings to describe embodiments of the present invention so as to enable a skilled person of the related art to achieve the present invention.

Figure 1A:
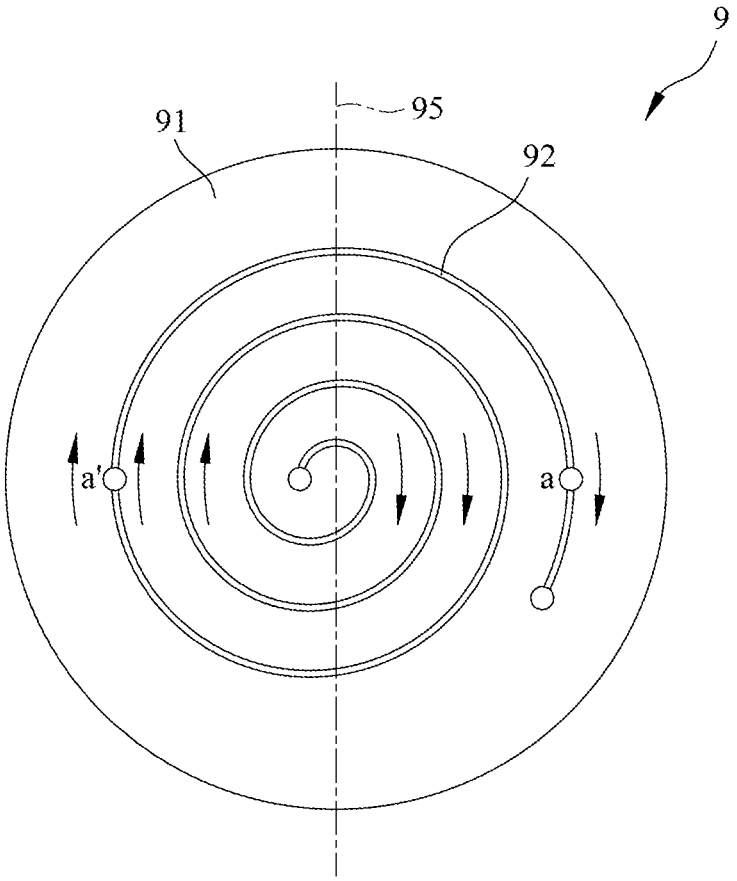
FIG. 1A (PRIOR ART)
FIG. 1A is schematic view of a conventional driver structure.
Figure 1B:
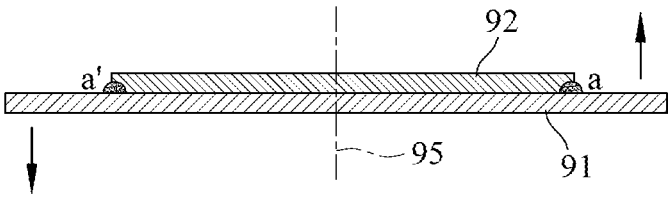
FIG. 1B (PRIOR ART)
FIG. 1B is a side view of the conventional driver structure.
Figure 2A:
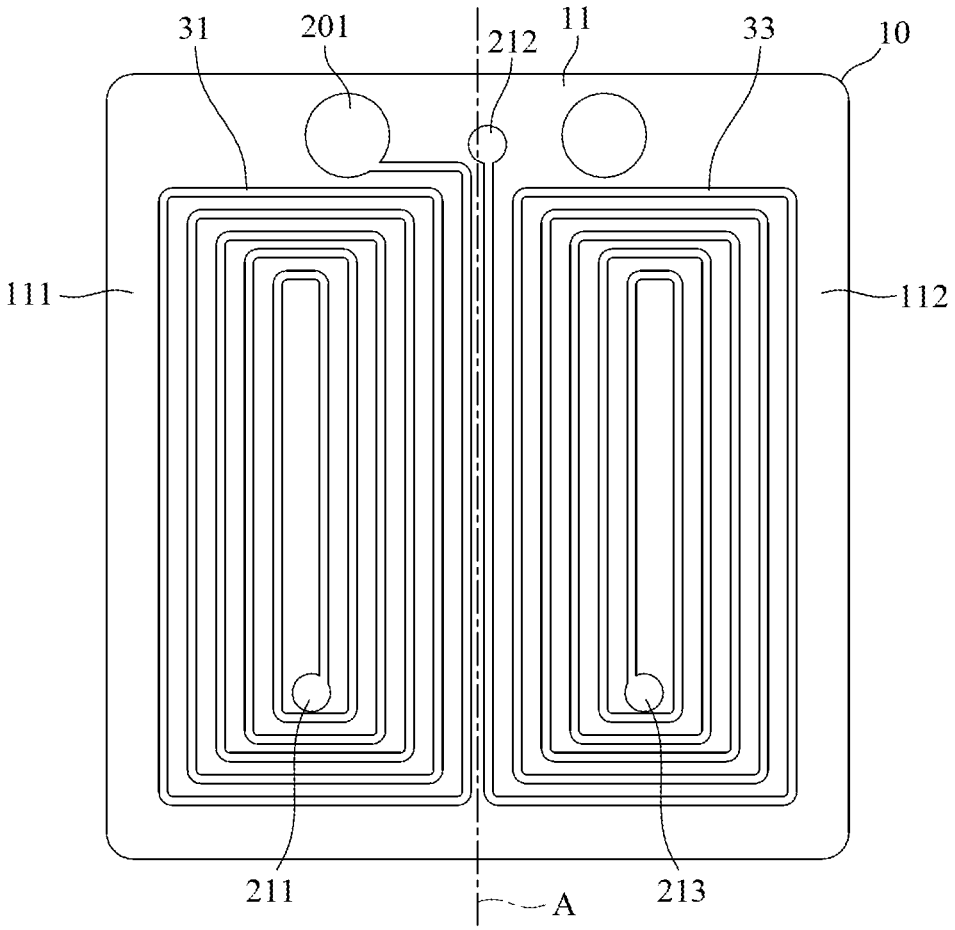
FIG. 2A is a planar view showing a first surface of a planar diaphragm driver having an improved structure according to an embodiment of the present invention.
Figure 2B:
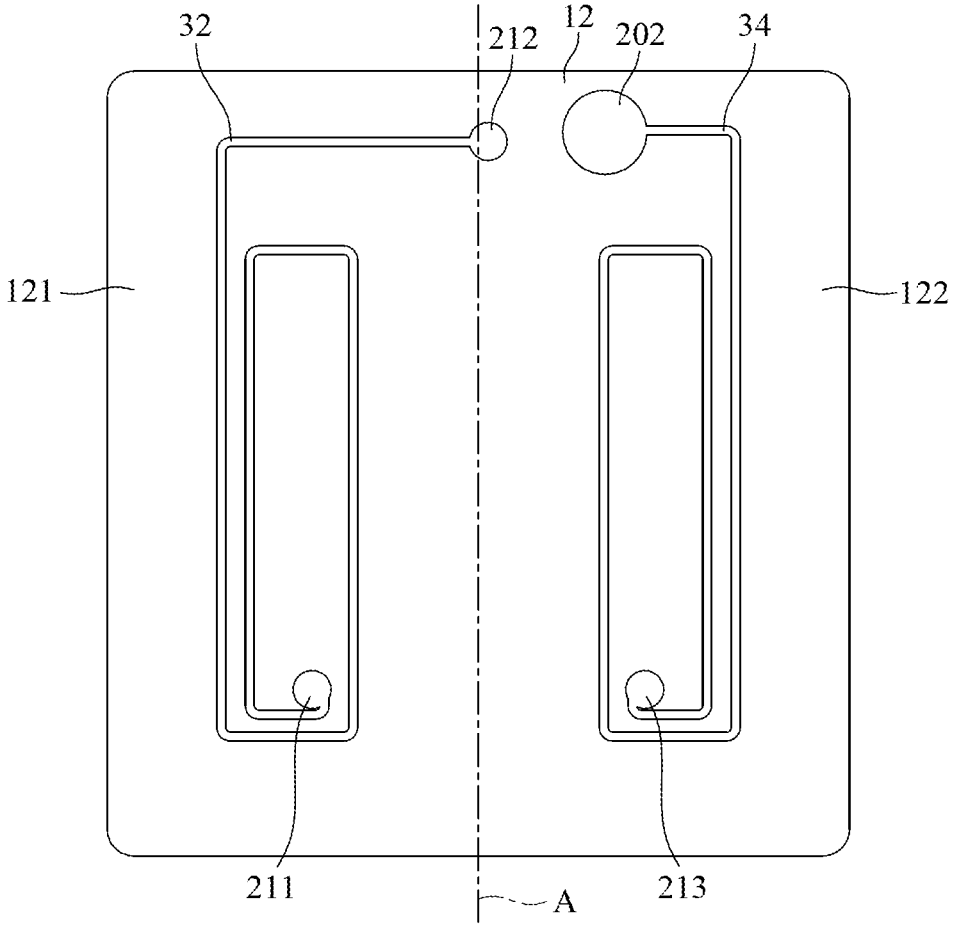
FIG. 2B is a planar view showing a second surface of the planar diaphragm driver having an improved structure according to an embodiment of the present invention.

FIG. 2A is a planar view showing a first surface of a planar diaphragm driver having an improved structure according to the present invention, and FIG. 2B is a planar view showing a second surface of a planar diaphragm driver having an improved structure according to the present invention. Referring to FIGS. 2A and 2B, an improved structure of a planar diaphragm driver comprises a membrane 10, a first coil 31, a second coil 32, a third coil 33 and a fourth coil 34. Reference is made hereinafter to FIGS. 2A and 2B to further describe the improved structure of the planar diaphragm driver according to the present invention.

The membrane 10 is the main structure of the driver diaphragm, and has a first surface 11 and a second surface 12. The first surface 11 of the membrane 10 has a first side 111 and a second side 112 opposite to each other relative to a central axis A of the membrane 10, and the second surface 12 of the membrane 10 also has a first side 121 and a second side 122 opposite to each other relative to the central axis A. In the present embodiment, the membrane 10 has a shape with four side edges, and the central axis A passes through the respective centers of two side edges of the membrane 10. It will be appreciated, however, that the membrane 10 is not limited to the illustrated example and may have any suitable shape for serving as a driver diaphragm, and the central axis may be any axis that can divide the membrane into two symmetric portions.

As shown in FIG. 2A, the first coil 31 is placed at the first side 111 on the first surface 11 of the membrane 10, and has a first contact point 201. In the present embodiment, the first contact point 201 is disposed on the first side 111 in an upper region of the first surface 11. From the first contact point 201, the first coil 31 winds into multiple turns, and then electrically connects to the second coil 32 placed at the first side 121 on the second surface 12 of the membrane 10 via a first connection point 211. The first connection point 211 is disposed centrally on the first side 111 in a lower region of the first surface 11 of the membrane 10, and extends through the membrane 10 to the second surface 12.

As shown in FIG. 2B, the second coil 32 is placed at the first side 121 on the second surface 12 of the membrane 10, and winds into a smallest number of turns generally overlapping with the first coil 31. In the present embodiment, the second coil 32 winds into one and a half turn, and then electrically connects to the third coil 33 placed at the second side 112 on the first surface 11 of the membrane 10 via a second connection point 212. The second connection point 212 is disposed in an upper region of the second surface 12 of the membrane 10, and extends through the membrane 10 to the first surface 11.

Referring again to FIG. 2A, the third coil 33 is disposed at the second side 112 on the first surface 11 of the membrane 10 starting from the second connection point 212, and is symmetric to the first coil 31 with respect to the central axis A. In other words, the third coil 33 and the first coil 31 are symmetric in shape and number of turns with respect to the central axis A. The third coil 33 electrically connects to the fourth coil 34 placed at the second side 122 on the second surface 12 of the membrane 10 via a third connection point 213, which is disposed centrally on the second side 112 in a lower region of the first surface 11 of the membrane 10 and extends through the membrane 10 to the second surface 12.

Referring to FIG. 2B, the fourth coil 34 is placed at the second side 122 on the second surface 12 of the membrane 10, and winds into a smallest number of turns generally overlapping with the third coil 33. Moreover, the fourth coil 34 and the second coil 32 are disposed on the second surface 12 of the membrane 10 symmetric to each other relative to the central axis A.

Figure 3:
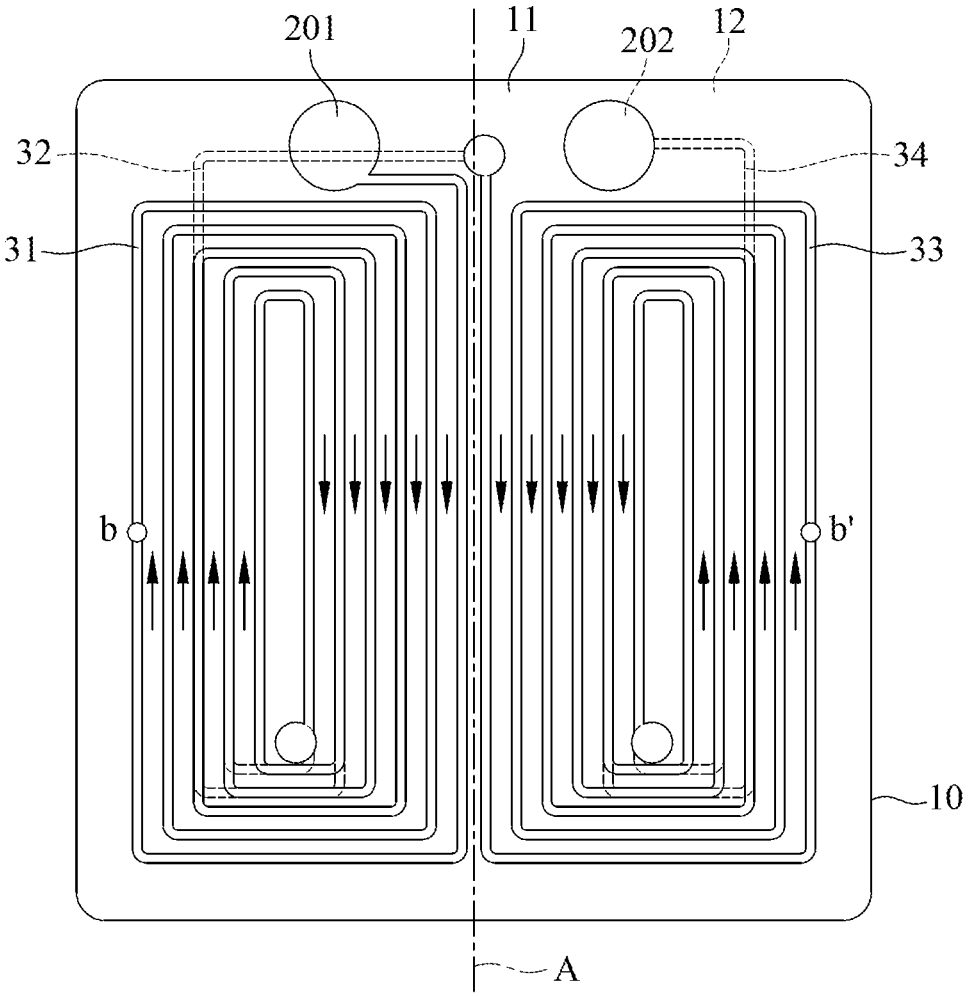
FIG. 3 is a schematic planar view showing an electric current flow in the coil arrangement provided in the planar diaphragm driver according to an embodiment of the present invention.

With the aforementioned coil arrangement, the occurrence of break and/or tear in the planar diaphragm driver can be reduced. Reference is made hereinafter to FIG. 3 for describing the mechanism of reducing the occurrence of break and/or tear in the planar diaphragm driver provided herein, wherein FIG. 3 is a schematic view showing an electric current flow in the coil arrangement provided in a planar diaphragm driver according to the present invention. As shown in FIG. 3, if an electric current flows from the first contact point 201 downward along the first coil 31 at a location near the central axis, the electric current at the point b on the first coil 31 would flow toward an upper region of FIG. 3. When the electric current flows through the first coil 31 and the second coil 32 and reaches the point b' on the third coil 33 that is symmetric to the point b on the first coil 31 relative to the central axis A, the electric current would also flow toward an upper region of FIG. 3 like at the point b. In other words, the flowing direction of an electric current is the same at two respective locations on the first coil 31 and the third coil 33 equidistant from the central axis A, and the flowing direction of an electric current is also the same at two respective locations on the second coil 32 and the fourth coil 34 equidistant from the central axis A. Accordingly, the vibrating direction of the planar diaphragm driver on a microscopic level can be kept uniform, which can reduce the occurrence of break and/or tear in the driver structure and increase treble performance.

Moreover, because the second coil 32 and the fourth coil 34 on the second surface 12 of the membrane 10 have a smallest number of turns, and the second coil 32 and the fourth coil 34 respectively overlap with the first coil 31 and the third coil 33 on the first surface 11, the interference of the second coil 32 and the fourth coil 34 on the first coil 31 and the third coil 33 can be reduced to a minimum, which can further reduce the occurrence of break and/or tear.

It is worth noting the coil arrangement illustrated in FIGS. 2A and 2B is only an example of the present invention, which can cover any coil arrangement as defined in the claims.

The planar diaphragm driver described herein has industrial applicability. Although the present invention has been described with reference to the preferred embodiments thereof, it is apparent to those skilled in the art that a variety of modifications and changes may be made without departing from the scope of the present invention which is intended to be defined by the appended claims.

What is claimed is:

1. A planar diaphragm driver having an improved structure, comprising:

a membrane having a first surface and a second surface, and a first and a second side opposite to each other relative to a central axis of the membrane;

a first coil disposed at the first side on the first surface of the membrane, the first coil having a first contact point;

a second coil disposed at the first side on the second surface of the membrane, the second coil being electrically connected to the first coil via a first connection point;

a third coil disposed at the second side on the first surface of the membrane, the third coil being electrically connected to the second coil via a second connection point;

a fourth coil disposed at the second side on the second surface of the membrane, the fourth coil being electrically connected to the third coil via a third connection point, the fourth coil having a second contact point;

wherein the first coil and the third coil are configured so that a flowing direction of an electric current is the same at two respective locations on the first coil and the third coil equidistant from the central axis, and the second coil and the fourth coil are configured so that a flowing direction of an electric current is the same at two respective locations on the second coil and the fourth coil equidistant from the central axis.

2. The planar diaphragm driver according to claim 1, wherein the first coil and the third coil are symmetric to each other relative to the central axis, and the second coil and the fourth coil are symmetric to each other relative to the central axis.

3. The planar diaphragm driver according to any one of claim 1, wherein the second coil overlaps with the first coil, the fourth coil overlaps with the third coil, a flowing direction of an electric current in a region where the second coil overlaps with the first coil being the same, and a flowing direction of an electric current in a region where the fourth coil overlaps with the third coil being the same.

4. The planar diaphragm driver according to claim 1, wherein the second coil and the fourth coil are disposed on the second surface of the membrane with a smallest number of turns.

5. The planar diaphragm driver according to claim 2, wherein the second coil and the fourth coil are disposed on the second surface of the membrane with a smallest number of turns.

6. The planar diaphragm driver according to claim 3, wherein the second coil and the fourth coil are disposed on the second surface of the membrane with a smallest number of turns.

* * * * *